US010375503B2

(12) United States Patent
Buerger et al.

(10) Patent No.: US 10,375,503 B2
(45) Date of Patent: Aug. 6, 2019

(54) APPARATUS AND METHOD FOR DRIVING AN ARRAY OF LOUDSPEAKERS WITH DRIVE SIGNALS

(71) Applicant: Huawei Technologies Co., Ltd., Shenzhen (CN)

(72) Inventors: Michael Buerger, Erlangen (DE); Heinrich Löllmann, Erlangen (DE); Walter Kellermann, Erlangen (DE); Peter Grosche, Munich (DE); Yue Lang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/786,278

(22) Filed: Oct. 17, 2017

(65) Prior Publication Data

US 2018/0098175 A1 Apr. 5, 2018

Related U.S. Application Data

(63) Continuation of application No. PCT/EP2015/058424, filed on Apr. 17, 2015.

(51) Int. Cl.
*H04R 3/12* (2006.01)
*H04S 7/00* (2006.01)

(52) U.S. Cl.
CPC ..... *H04S 7/303* (2013.01); *H04R 3/12* (2013.01); *H04S 7/30* (2013.01); *H04S 2400/11* (2013.01);
(Continued)

(58) Field of Classification Search
CPC ... G10L 19/008; G10L 19/0204; G10L 19/22; H04S 2400/03; H04S 2400/11; H04S 2400/01
(Continued)

(56) References Cited

U.S. PATENT DOCUMENTS

2005/0190935 A1* 9/2005 Sakamoto ..... H04R 5/02 381/302
2010/0329466 A1* 12/2010 Berge ..... H04R 3/12 381/22
(Continued)

FOREIGN PATENT DOCUMENTS

CN 102165797 A 8/2011
CN 103109549 A 5/2013
(Continued)

OTHER PUBLICATIONS

Burger et al., "Deliverables WP-C1 and WP-R5: Report on Scenario Definition for ANC and Synthesis of P2PR and LWDR," HIRP report, Huawei Technologies (Nov. 2013-Jan. 2014).*
(Continued)

*Primary Examiner* — Alexander Jamal
(74) *Attorney, Agent, or Firm* — Leydig, Voit & Mayer, Ltd.

(57) ABSTRACT

A wave field synthesis apparatus for driving an array of loudspeakers with drive signals, the apparatus includes a sound field synthesizer for generating sound field drive signals for causing the array of loudspeakers to generate one or more sound fields at one or more audio zones, a binaural renderer for generating binaural drive signals for causing the array of loud-speakers to generate specified sound pressures at at least two positions, wherein the at least two positions are determined based on a detected position and/or orientation of a listener, and a decision unit for deciding whether to generate the drive signals using the sound field synthesizer or using the binaural renderer.

15 Claims, 9 Drawing Sheets

(52) U.S. Cl.
CPC ..... *H04S 2420/01* (2013.01); *H04S 2420/13* (2013.01)

(58) Field of Classification Search
USPC ..... 381/300, 303, 17, 22, 86
See application file for complete search history.

(56) References Cited

U.S. PATENT DOCUMENTS

| | | | | |
|---|---|---|---|---|
| 2012/0057710 | A1 | 3/2012 | Disch et al. | |
| 2013/0114819 | A1 | 5/2013 | Melchior et al. | |
| 2014/0064526 | A1* | 3/2014 | Otto | H04S 5/00 381/300 |
| 2016/0080886 | A1* | 3/2016 | De Bruijn | H04S 7/302 381/17 |

FOREIGN PATENT DOCUMENTS

| | | | |
|---|---|---|---|
| DE | 102007032272 | A1 | 1/2009 |
| WO | 2012068174 | A2 | 5/2012 |
| WO | 2014184353 | A1 | 11/2014 |

OTHER PUBLICATIONS

Wu et al., "Spatial Multizone Soundfield Reproduction: Theory and Design," IEEE Transactions on Audio, Speech, and Language Processing, vol. 19, No. 6, pp. 1711-1720, Institute of Electrical and Electronics Engineers, New York, New York (Aug. 2011).
Cai et al., "Sound reproduction in personal audio systems using the least-squares approach with acoustic contrast control constraint," The Journal of the Acoustical Society of America, vol. 135, No. 2, pp. 734-741, Acoustical Society of America (2014).
Choi et al., "Generation of an acoustically bright zone with an illuminated region using multiple sources," The Journal of the Acoustical Society of America, vol. 111, No. 4, pp. 1695-1700, Acoustical Society of America (2002).
Jin et al., "Multizone Soundfield Reproduction Using Orthogonal Basis Expansion," IEEE International Conference on Acoustics, Speech and Signal Processing (ICASSP), pp. 311-315, Institute of Electrical and Electronics Engineers, New York, New York (2013).
Kirkeby et al., "Local sound field reproduction using two closely spaced loudspeakers," Journal of the Acoustical Society of America (JASA), pp. 1973-1981, Acoustical Society of America (1998).
Poletti et al., "An Investigation of 2D Multizone Surround Sound Systems," Audio Engineering Society Convention Paper 7551, 125th Convention, San Francisco, CA (Oct. 2-5, 2008).
Shin et al., "Maximization of acoustic energy difference between two spaces," The Journal of the Acoustical Society of America, vol. 128, No. 1, pp. 121-131, Acoustical Society of America (2010).
Spors et al., "The Theory of Wave Field Synthesis Revisited," Audio Engineering Society Convention 124, Amsterdam, The Netherlands, (May 17-20, 2008).
Takeuchi et al., "Optimal source distribution for binaural synthesis over loudspeakers," Journal of the Acoustic Society of America, pp. 2786-2797, Acoustical Society of America, (2002).
Zotkin et al., "Creation of Virtual Auditory Spaces." IEEE International Conference on Acoustics, Speech, and Signal Processing (ICASSP), pp. 2113-2116, Institute of Electrical and Electronics Engineers, New York, New York (2002).
Helwani et al., "The synthesis of sound figures," Multidimensional Systems and Signal Processing, vol. 25, No. 2, pp. 379-403, Springer (2014).

* cited by examiner

APPARATUS AND METHOD FOR DRIVING AN ARRAY OF LOUDSPEAKERS WITH DRIVE SIGNALS

CROSS-REFERENCE TO RELATED APPLICATIONS

This application is a continuation of International Application No. PCT/EP2015/058424, filed on Apr. 17, 2015, the disclosure of which is hereby incorporated by reference in its entirety.

TECHNICAL FIELD

Embodiments of the present invention relate to an apparatus and a method for driving an array of loudspeakers with drive signals. Embodiments of the present invention also relate to a computer-readable storage medium storing program code, the program code comprising instructions for carrying out such a method.

Aspects of the present invention relate to personalized sound reproduction of individual 3D audio which combines local sound field synthesis, i.e., approaches such as local wave domain rendering (LWDR) and local wave field synthesis (LWFS), with point-to-point rendering (P2P rendering) such as binaural beamforming or crosstalk cancellation.

BACKGROUND

There are several known approaches for providing personalized spatial audio to multiple listeners at the same time. A first group of methods uses local sound field synthesis (SFS) approaches, such as (higher order) ambisonics, wave field synthesis and techniques related to it, and a multitude of least squares approaches (e.g. pressure matching or acoustic contrast maximization). These techniques aim at reproducing a desired sound field in multiple spatially extended areas (audio zones).

A second group comprises binaural rendering (BR) or point-to-point (P2P) rendering approaches, e.g., binaural beamforming or crosstalk cancellation. Their aim is to generate the desired hearing impression by evoking proper interaural time differences (ITDs) and interaural level differences (ILDs) at the ear positions of the listeners. Thereby, virtual sources are perceived at desired positions. As opposed to SFS, where the desired sound field is reproduced in spatially extended areas, only the ear positions are considered in case of BR.

Both approaches (BR and SFS) have drawbacks (limitations) and advantages. A fundamental drawback of BR systems is the limited robustness with respect to movements or rotations of the listeners' heads. This is due to the fact that the sound field is inherently optimized for the ear positions only, i.e., for a specific head position and orientation.

In case of SFS, many loudspeakers should ideally surround the entire listening area such that virtual sources can be synthesized for all directions. Furthermore, SFS is generally more affected by spatial aliasing, since a proper sound field needs to be generated in an entire area rather than at single points (ear positions) only. Similarly, it is challenging to properly synthesize the sound field with SFS for very low frequencies, which is again due to the fact that the sound field must be synthesized in a spatially extended area, whereas for BR the sound field needs to be controlled at the ear positions only. In return, SFS provides a much higher robustness with respect to movements/rotations of the listeners' heads, since the desired sound field is synthesized in spatially extended areas rather than evoking ITDs and ILDs at certain points in space. As a consequence, head rotations and small head movements do not deteriorate the hearing impression. Moreover, SFS is independent of the head-related transfer functions (HRTFs) of the listeners, which play a crucial role in sound perception and BR.

SUMMARY OF THE INVENTION

The objective of the present invention is to provide an apparatus and a method for driving an array of loudspeakers with drive signals, wherein the apparatus and the method provide a better listening experience for the one or more listeners.

A first aspect of the invention provides a wave field synthesis apparatus for driving an array of loudspeakers with drive signals, the apparatus comprising:

- a sound field synthesizer for generating sound field drive signals for causing the array of loudspeakers to generate one or more sound fields at one or more audio zones,
- a binaural renderer for generating binaural drive signals for causing the array of loud-speakers to generate specified sound pressures at at least two positions, wherein the at least two positions are determined based on a detected position and/or orientation of a listener, and
- a decision unit for deciding whether to generate the drive signals using the sound field synthesizer or using the binaural renderer.

The decision unit can be configured to decide whether to generate the drive signals using the sound field synthesizer or using the binaural renderer in such a way that the listening experience for one or more listeners is optimized. Thus, the advantages of sound field synthesis and binaural rendering can be combined. Optimal audio rendering can be maintained even in cases where local sound field synthesis is not feasible or not reasonable.

In embodiments of the invention, this can result in more flexibility for placing the loudspeakers.

The wave field synthesis apparatus according to the first aspect makes it possible to provide personalized spatial audio to multiple listeners at the same time, where two different groups of rendering approaches are combined in order to exploit the benefits of both.

Depending on the positions of the listeners, the positions of the loudspeakers, and the positions of the virtual sources to be synthesized, frequency bands can be determined in which reproduction is done either via sound field synthesis or binaural rendering. A desired virtual source can be perceived within a local audio zone ("bright zone"), while the sound intensity in a second (third, fourth, . . . ) local audio zone ("dark zone(s)") can be minimized. In embodiments of the invention, in order to synthesize individual sound fields in the remaining audio zones, the process is repeated for each audio zone, where one of the previously dark zones has now the role of the bright zone and vice versa. The overall sound field for multiple users can then be obtained by a superposition of all individual sound field contributions.

It is understood that the wave field synthesis apparatus does not need to comprise an amplifier, i.e., the drive signals generated by the wave field synthesis apparatus may need to be amplified by an external amplifier before they are strong enough to directly drive loudspeakers. Also, the drive signals generated by the wave field synthesis apparatus might be digital signals which need to be converted to analog signals and amplified before they are used to drive the loudspeakers.

In a first implementation of the apparatus according to the first aspect, the decision unit is configured to decide based on defined positions of the array of loudspeakers, a virtual position of a virtual sound source, a location and/or extent of the one or more audio zones, the detected position of a listener and/or the detected orientation of a listener.

The defined positions of the loudspeakers can be stored in an internal memory of the wave field synthesis apparatus. For example, the wave field synthesis apparatus can comprise an input device through which a user can enter the positions of the loudspeakers of the loudspeaker array.

Alternatively, the positions of the loudspeakers can be provided to the wave field synthesis apparatus through an external bus connection. For example, this could be a bus connection to a stereo system that stores information about the positions of the loudspeakers.

The decision of the decision unit can also be based on a virtual position, a virtual orientation and/or a virtual extent of the sound source relative to the control points. For example, certain combinations of positions of the loudspeakers and the positions of the virtual source may be less suitable for generating the drive signals using the sound field synthesizer. Thus, it is advantageous if the decision unit considers this information.

In a second implementation of the apparatus according to the first aspect, the decision unit is configured to decide to generate the drive signals for a selected audio zone of the one or more audio zones using the sound field synthesizer if a sufficient number of loudspeakers of the array of loudspeakers are located in a virtual tube around a virtual line between a listener position and a virtual position of a virtual source.

If no or only an insufficient number of loudspeakers are placed in the angular direction in which virtual sources should be synthesized (from which sound waves should originate), SFS is not reasonable. Then, according to the second implementation, BR can be used as a fallback solution for the entire frequency range.

Thus, a high quality listening experience can be provided to the listener even in cases where only a small number of loudspeakers is available.

The number of loudspeakers that are available can also be limited because objects are located between the selected audio zone and the listener. Therefore, the wave field synthesis apparatus according to the second implementation can be configured to ignore loudspeakers that are blocked because of objects that are located between a selected audio zone and the loudspeakers. In particular, the wave field synthesis apparatus can comprise an object detection unit for obtaining information about objects in the room. For example, the object detection unit could be connected to a camera through which the wave field synthesis apparatus can obtain image frames which show the room. The object detection unit can be configured to detect one or more objects that are located in the room in image frames that are acquired by the camera. Furthermore, the object detection unit can be configured to determine a size and/or location of the one or more detected objects.

In a third implementation of the apparatus according to the first aspect, the decision unit is configured to decide to generate the drive signals for a selected audio zone of the one or more audio zones using the sound field synthesizer if an angular direction from the selected audio zone to a virtual source of one of the one or more sound fields deviates by more than a predefined angle from one or more angular directions from the selected audio zone to one or more remaining audio zones of the one or more audio zones.

If the difference in angular direction is too small, SFS is not feasible, since bright and dark zone are too close to each other and in particular, a dark zone may be in between a bright zone and a virtual source. Therefore, BR can be used as a fallback solution for the entire frequency range.

In a fourth implementation of the apparatus according to the first aspect, the angular directions are determined based on centers of the selected audio zone and the one or more remaining audio zones.

In a fifth implementation of the apparatus according to the first aspect, the one or more audio zones comprise a dark zone that is substantially circular, and a bright zone that is substantially circular, wherein the decision unit is configured to decide to generate the drive signals using the sound field synthesizer if $$|\phi| \geq 90^\circ - \arccos\left(\min\left\{\gamma \frac{R_i + R_j}{D + R_i + R_j}, 1\right\}\right)$$

wherein $\phi$ is an angle between an angular direction from a center of the bright zone to a center of the dark zone and an angular direction from the center of the bright zone to a location of a virtual source, $R_i$ is a radius of the bright zone, $R_j$ is a radius of the dark zone, D is a distance between a center of the first zone and a center of the second zone, and $\gamma$ is a predetermined parameter with $|\gamma| \geq 1$.

For the proposed decision rule as used in the third implementation of the apparatus of the present invention, sound waves are modelled as traveling in a straight channel, i.e., as if their spatial extension was limited sharply. The fifth implementation assumes a more realistic model of the propagation of the sound waves and presents a more flexible decision rule.

In a sixth implementation of the apparatus according to the first aspect, the apparatus further comprises a splitter for separating a source signal into one or more split signals based on a property of the source signal, wherein the decision unit is configured to decide for each of the split signals whether to generate corresponding drive signals using the sound field synthesizer or using the binaural renderer.

For example, the splitter could be configured to split the source signal into a voice signal and a remaining signal which comprises the non-voice components of the source signal. Thus, for example the voice signal can be used as input for the binaural renderer and the remaining signal can be used as input for the sound field synthesizer. Then, the voice signal can be reproduced using the binaural renderer with small virtual extent and the remaining signal can be reproduced using the sound field synthesizer with a larger virtual extent. This results in a better separation of the voice signal from the remaining signal which can lead for example to increased speech intelligibility.

In other embodiments, the splitter could be configured to split the source signal into a foreground signal and a background signal. For example, foreground signal can be used as input for the binaural renderer and the background signal can be used as input for the sound field synthesizer. Then, the foreground signal can be reproduced using the binaural renderer with small virtual extent and the background signal can be reproduced using the sound field synthesizer with a larger virtual extent. This results in a better separation of the foreground signal from the background signal.

The splitter can be an analog or a digital splitter. For example, the source signal could be a digital signal which comprises several digital channels. The channels could comprise information about the content of each channel. For example, one of the several digital channels can be designated (e.g. using metadata that are associated with the channel) to comprise only the voice component of the complete signal. Another channel can be designated to comprise only background components of the complete signal. Thus, the splitter can "split" a plurality of differently designated channels based on their designation. For example, five channels could be designated as background signals and three channels could be designated as foreground signals. The splitter could then assign the five background channels to the binaural renderer and the three foreground channels to the sound field synthesizer.

The source signal can comprise at least one channel that is associated with metadata about a virtual source. The metadata can comprise information about a virtual position, a virtual orientation and/or a virtual extent of the virtual source. The splitter can then be configured to split the source signal based this metadata, e.g. based on information about a virtual extent of the virtual source associated with one or more of the channels. In this way, channels that correspond to a virtual source with a large extent can be assigned by the decision unit to be reproduced using sound field synthesis and channels that correspond to a virtual source with a small extent can be assigned by the decision unit to be reproduced using binaural rendering. For example, a predetermined virtual extent threshold can be used to decide whether a channel that corresponds to a certain virtual source should be reproduced using the sound field synthesizer or using the binaural renderer.

In a seventh implementation of the apparatus according to the first aspect, the decision unit is configured to set one or more parameters of the splitter.

For example, the decision unit can set a parameter that indicates which parts of the signal should be considered as background and which as foreground. In other embodiments, the decision unit could set a parameter that indicates into how many foreground and background channels the source signal should be split.

In yet other embodiments, the decision unit can be configured to set a split frequency of the splitter. Furthermore, the decision unit can be configured to set parameters of the splitter which indicate which of several channels of the source signal are assigned to the sound field synthesizer and which are assigned to the binaural renderer.

In an eighth implementation of the apparatus according to the first aspect, the splitter is a filter bank for separating the source signal into one or more bandwidth-limited signals.

For example, the filter bank can be configured such that below a certain minimum frequency □min (e.g., 200 Hz) and above a maximum frequency □max (e.g., the spatial aliasing frequency $$\omega_{alias} = 2\pi f_{alias} = 2\pi \frac{c}{2d}$$

of the loudspeaker array, where c and d denote the speed of sound and the loudspeaker spacing, respectively), BR is used. In the remaining frequency range, SFS is utilized in order to obtain a large robustness with respect to head movements and rotations.

In a ninth implementation of the apparatus according to the first aspect, the filter bank is adapted to separate the source signal into two or more bandwidth-limited signals that partially overlap in frequency domain.

In this implementation, the transition between SFS and BR is smooth, i.e., there is no abrupt change along the frequency axis, but fading is applied.

In a tenth implementation of the apparatus according to the first aspect, the binaural renderer is configured to generate the binaural drive signals based on one or more head-related transfer functions, wherein in particular the one or more head-related transfer functions are retrieved from a database of head-related transfer functions.

Head-related transfer functions can describe for left and right ear the filtering of a sound source before it is perceived at the left and right ears. A head-related transfer function can also be described as the modifications to a sound from a direction in free air to the sound as it arrives at the left and right eardrum. These modifications can for example be based on the shape of the listener's outer ear, the shape of the listener's head and body as well as acoustical characteristics of the space in which the sound is played.

Different head-shapes can be stored in a database together with corresponding head-related transfer functions. In embodiments of the invention, the wave field synthesis apparatus can comprise a camera for acquiring image frames and a head detection unit for detecting a head shape of the listener based on the acquired image frames. A corresponding head-transfer function can then be looked-up in the database of head-related transfer functions.

A second aspect of the invention refers to a method for driving an array of loudspeakers with drive signals to generate one or more local wave fields at one or more audio zones, the method comprising the steps:

- detecting a position and/or an orientation of a listener, and
- deciding whether to generate the drive signals using the sound field synthesizer or whether to generate the drive signals using the binaural renderer, and
- generating sound field drive signals for causing the array of loudspeakers to generate one or more sound fields at one or more audio zones, and/or
- generating binaural drive signals for causing the array of loudspeakers to generate specified sound pressures at at least two positions, wherein the at least two positions are determined based on the detected position and/or the detected orientation of the listener.

The method according to the second aspect of the invention can be performed by the apparatus according to the first aspect of the invention. Further features or implementations of the method according to the second aspect of the invention can perform the functionality of the apparatus according to the first aspect of the invention and its different implementation forms.

In a first implementation of the method of the second aspect, the loudspeakers are located in a car. In cars, dark audio zones can be of particular importance, e.g. a dark audio zone can be located at the driver's seat so that the driver is not distracted by music that the other passengers would like to enjoy.

Locating the loudspeakers in a car and applying the inventive method to the loudspeakers in the car is also advantageous because the location of the loudspeakers as well as the possible positions of the listeners in the car are well-defined. Therefore, transfer functions from speakers to listeners can be computed with high accuracy.

In a second implementation of the method of the second aspect, detecting a position and/or an orientation of a listener comprises a step of detecting which seats of the car are occupied by passengers.

For example, a pressure sensor can be used to detect which seat of the car is occupied.

A third aspect of the invention refers to a computer-readable storage medium storing program code, the program code comprising instructions for carrying out the method of the second aspect or one of the implementations of the second aspect.

BRIEF DESCRIPTION OF THE DRAWINGS

To illustrate the technical features of embodiments of the present invention more clearly, the accompanying drawings provided for describing the embodiments are introduced briefly in the following. The accompanying drawings in the following description are merely some embodiments of the present invention, but modifications on these embodiments are possible without departing from the scope of the present invention as defined in the claims.

DETAILED DESCRIPTION OF THE EMBODIMENTS

Figure 1:
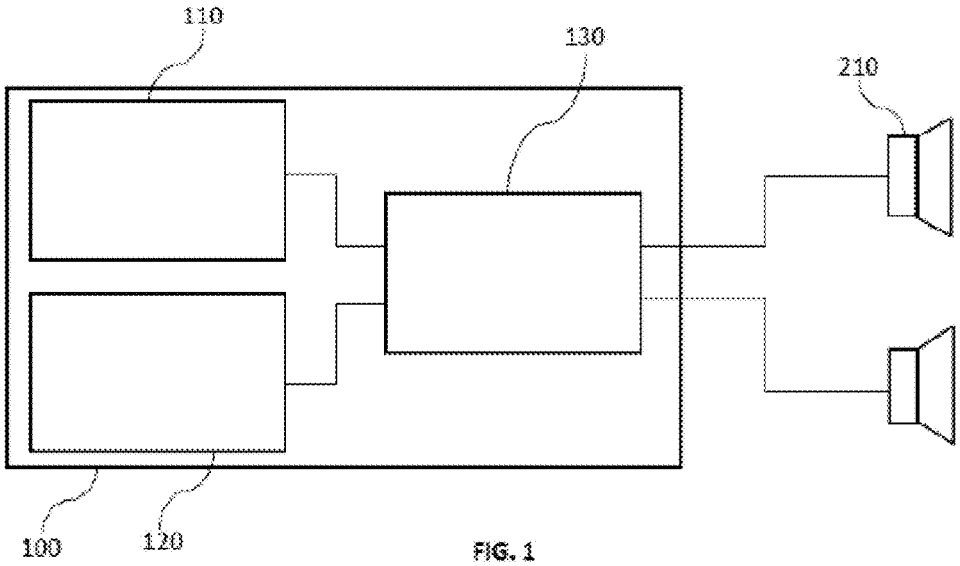
FIG. 1 shows a schematic illustration of a wave field synthesis apparatus in accordance with the invention.

FIG. 1 shows a schematic illustration of a wave field synthesis apparatus 100 in accordance with the present invention. The wave field synthesis apparatus 100 comprises a sound field synthesizer 110 and a binaural renderer 120. The sound field synthesizer 110 and the binaural renderer 120 are connected to a decision unit 130. FIG. 1 shows an embodiment of the invention, where the decision unit 130 is connected to loudspeakers 210 that are external to the wave field synthesis apparatus 100. For example, the decision unit 130 can comprise a filter bank. In other embodiments of the invention, other connections are provided between the units of the wave field synthesis apparatus 100 and the loudspeakers 210.

Figure 2:
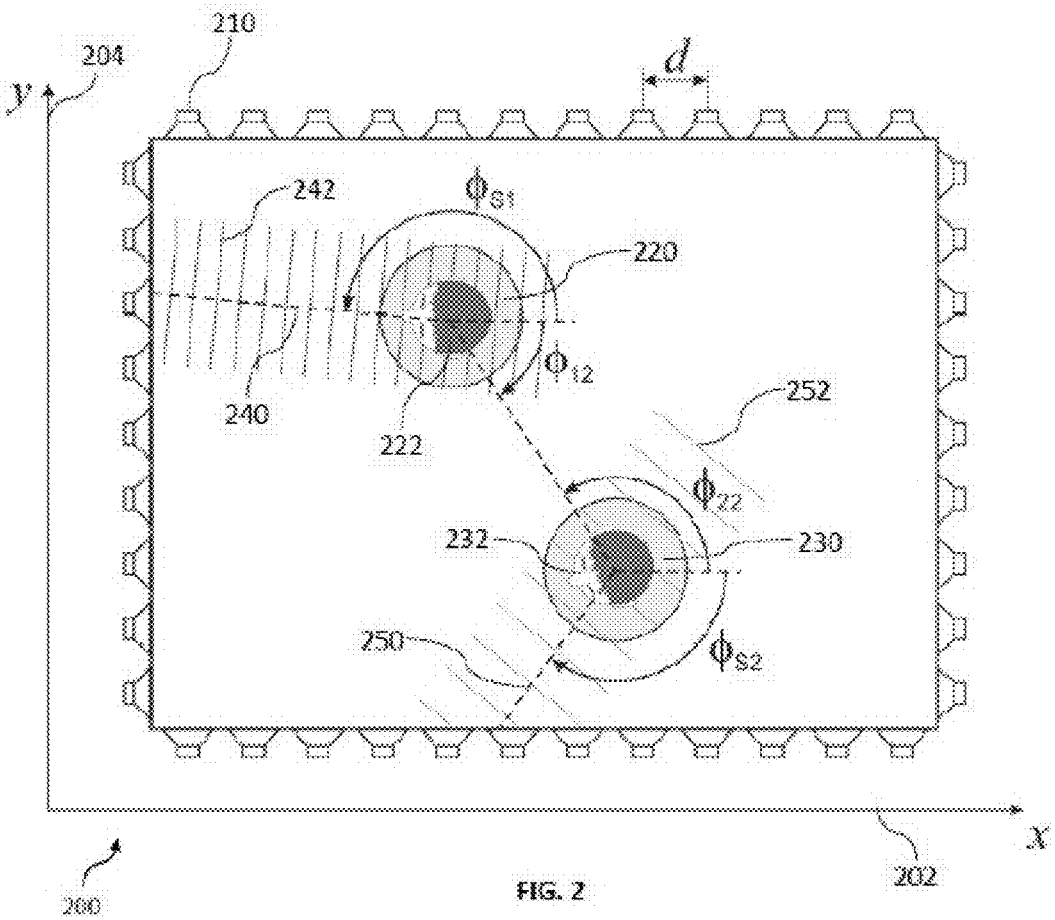
FIG. 2 shows a schematic illustration of a listening area which is provided with sound from a rectangular array of loudspeakers.

FIG. 2 shows a schematic illustration of a listening area 200 which is provided with sound from a rectangular array of loudspeakers 210. The loudspeakers 210 are located at equispaced positions with distance d between them. The x-axis and the y-axis of a coordinate system are indicated with arrows 202, 204. In the embodiment shown in FIG. 2, the array of loudspeakers 210 is aligned with the axes 202, 204. However, in general, the loudspeakers can be oriented in any direction relative to a coordinate system. In particular, the arrangement of the array of loudspeakers 210 does not need to be rectangular, but could be circular, elliptical or even randomly distributed, wherein preferably the random locations of the loudspeakers are known to the wave field synthesis apparatus.

Two listeners 222, 232 are surrounded by the array of loudspeakers 210. The first listener 222 is located in a first audio zone 220 and the second listener 232 is located in a second audio zone 230.

Angles $\phi_{S1}$, $\phi_{12}$, $\phi_{22}$, and $\phi_{S2}$ are defined relative to the x-axis. $\phi_{S1}$ and $\phi_{S2}$ indicate the angles of the directions 240, 250 of sound waves 242, 252 from a first and second virtual source (not shown in FIG. 2). Angles $\phi_{12}$ and $\phi_{22}$ indicate the angles from the center of the first audio zone 220 to the center of the second audio zone 230.

Figure 3:
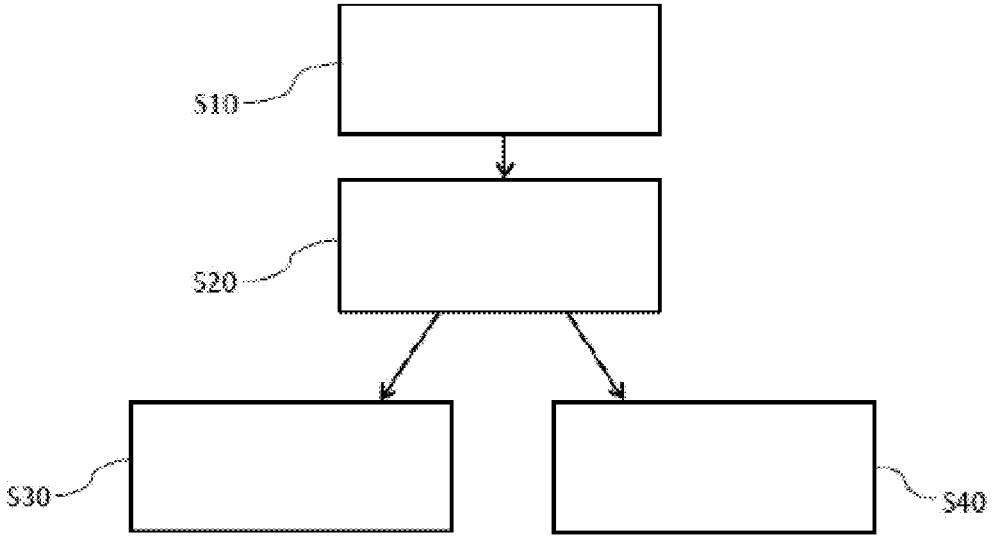
FIG. 3 shows a diagram of a method for driving an array of loudspeakers with drive signals according to an embodiment of the present invention.

FIG. 3 shows a diagram of a method for driving an array of loudspeakers with drive signals according to an embodiment of the present invention. In a first step S10, a position and/or an orientation of a listener is detected. In a second step S20, it is decided whether to generate the drive signals using the sound field synthesizer or whether to generate the drive signals using the binaural renderer. In third and fourth steps S30 and S40, sound field drive signals for causing the array of loudspeakers to generate one or more sound fields at one or more audio zones are generated or binaural drive signals for causing the array of loudspeakers to generate specified sound pressures at at least two positions are generated. In general, the steps need not be carried out in this order. For example, the second step S20 can be performed by a filter bank which is operated at the same time as a sound field synthesizer for generating the sound field drive signals and a binaural renderer for generating the binaural drive signals. In this way, the second, third and fourth step S20, S30 and S40 are carried out simultaneously. Furthermore, the detection of the position and/or orientation of a listener in step S10 can be carried out periodically or continuously and thus also simultaneously with the other steps.

Figure 4:
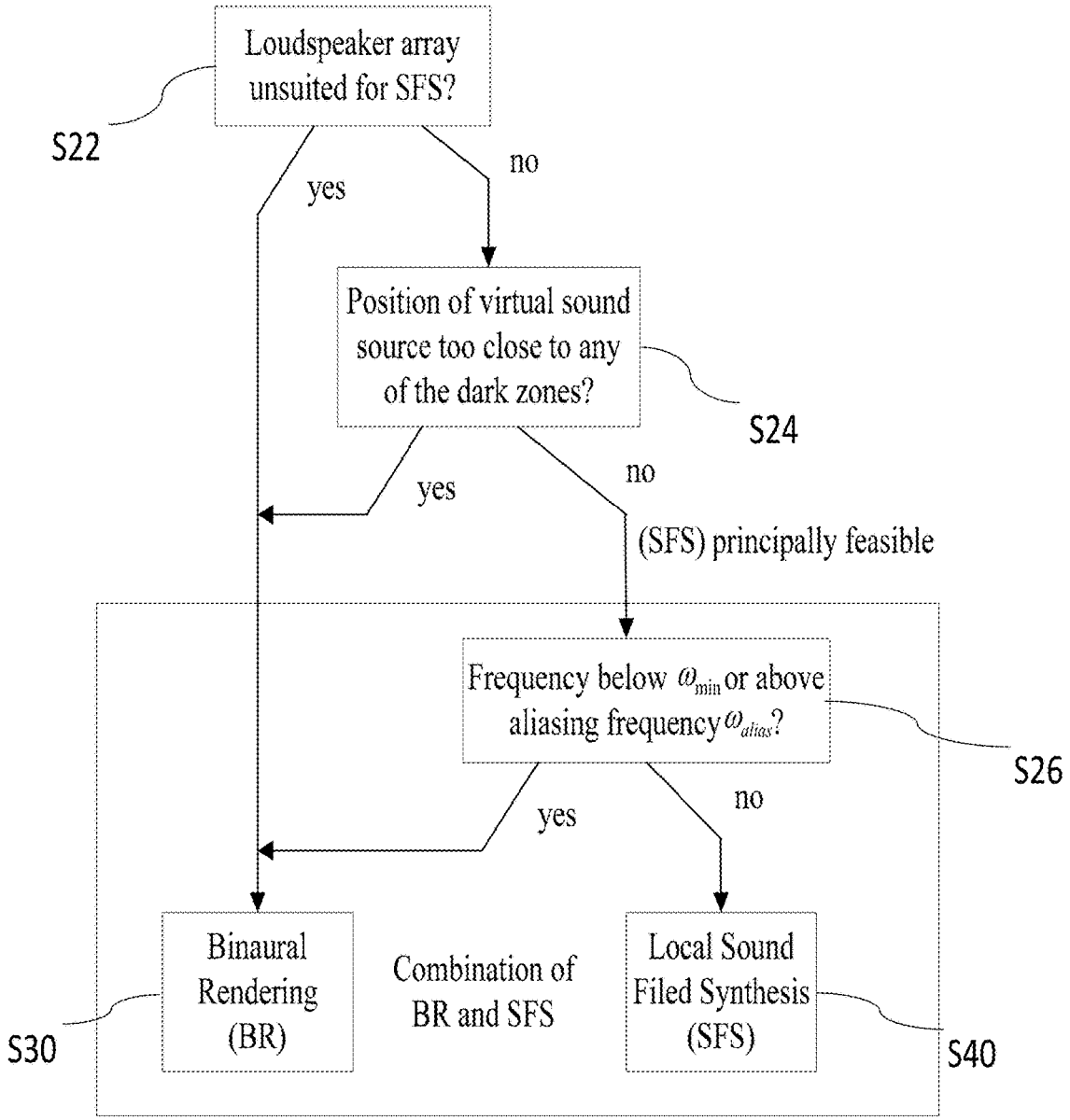
FIG. 4 shows a diagram that further illustrates some of the steps of the method of FIG. 3.

FIG. 4 shows a diagram that further illustrates the steps related to deciding whether to generate the drive signals using the sound field synthesizer or whether to generate the drive signals using the binaural renderer.

In step S22, it is determined whether the array of loudspeakers is unsuited for sound field synthesis (SFS). For example, if no or only an insufficient number of loudspeakers are placed in the angular direction in which virtual sources should be synthesized (from which sound waves should originate), SFS is not reasonable. Then, it is decided that binaural rendering (BR) drive signals should be generated in step S30 as a fallback solution for the entire frequency range.

In step S24, it is determined whether the position of the virtual sound source is too close to any of the dark zones: If the angular direction $\phi_{S_i}$ of a virtual source to be synthesized in a particular zone i deviates by less than a predefined angle $\phi_{min}$ from the angular direction $\phi_{ij}$, $j \in \{1,2, \ldots, N\} \backslash i$ of any of the remaining N-1 zones, SFS is not feasible, since the bright zone and the dark zone are too close to each other. Then, BR is used as a fallback solution for the entire frequency range (step S30).

Unless in steps S22 and S24 it is decided that SFS is principally not feasible, SFS and BR are used simultaneously. In step S26, a filter bank is used to separate the source signal into two signals. Below a certain frequency co min (e.g., 200 Hz) and above a maximum frequency ωmax (e.g., the spatial aliasing frequency $$\omega_{alias} = 2\pi f_{alias} = 2\pi \frac{c}{2d}$$

of the loudspeaker array, where c and d denote the speed of sound and the loudspeaker spacing, respectively), BR is used. In the remaining frequency range, SFS is utilized in order to obtain a large robustness with respect to head movements and rotations. The transition between SFS and BR is smooth, i.e., there is no abrupt change along the frequency axis, but fading is applied.

Figure 5:
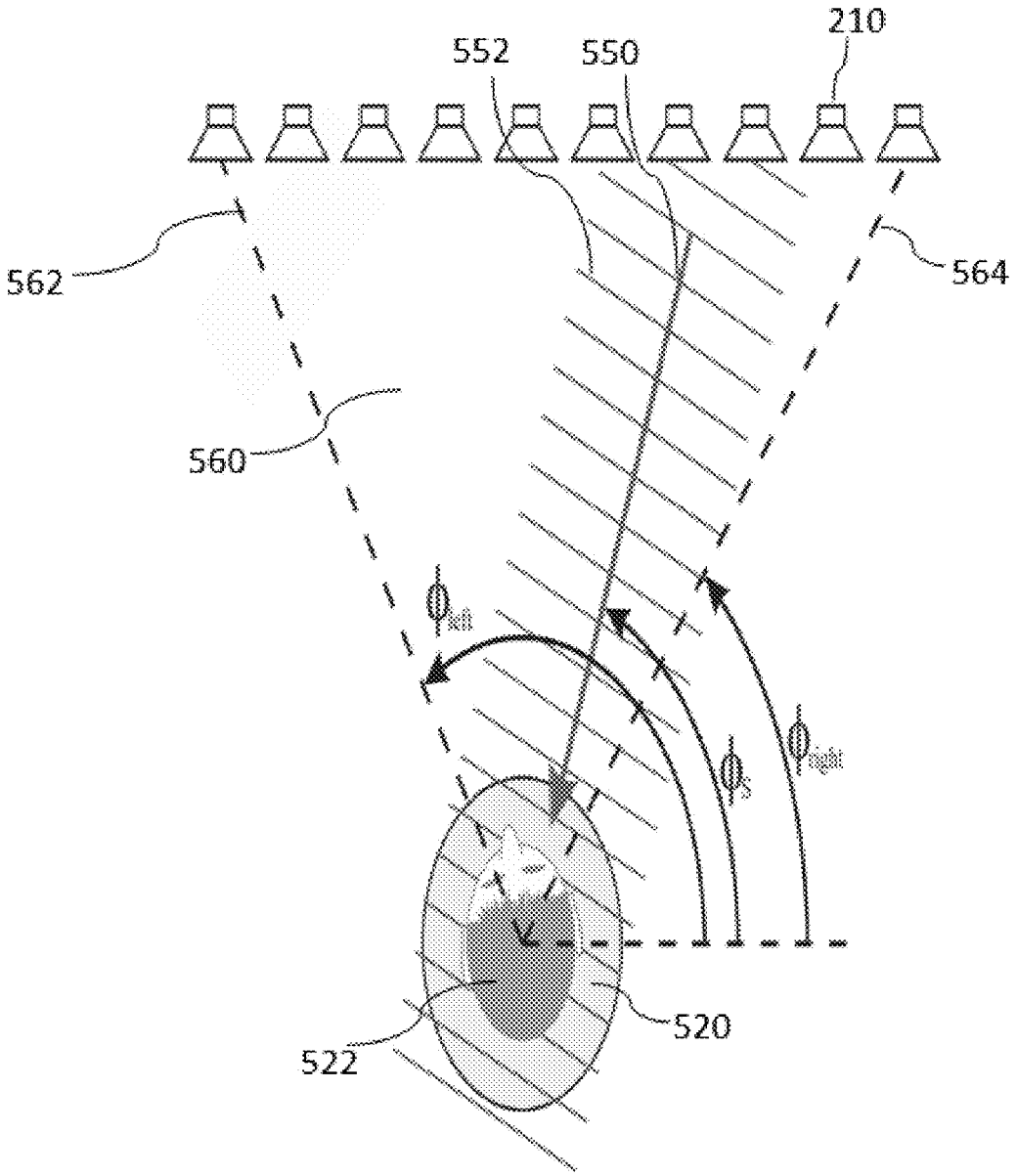
FIG. 5 illustrates an angular region for which a decision unit can be configured to decide that sound field synthesis is feasible.

FIG. 5 illustrates a decision rule that depends on an angular range 560 in which closely-spaced loudspeakers are required for sound field synthesis to be used. A listener 522 is located at the center of an audio zone 520. Arrow 550 indicates the direction of sound from a virtual source. The lines 552 that are orthogonal to the arrow 550 indicate a (modelled) extension of the sound waves travelling towards the listener 522. The angles $\phi_s$, $\phi_{left}$ and $\phi_{right}$ are defined relative to an x-axis of a coordinate system (not shown in FIG. 5). $\phi_s$ indicates the source angle of the virtual source which is sending sound waves 552 from a direction 550, $\phi_{left}$ and $\phi_{right}$ indicate the angles towards the left and right edge, respectively, of the loudspeaker array 210. The angular region 560 is defined by the maximum left direction 562 and the maximum right direction 564.

If the source angle $\phi_s$ does not lie in the interval $[\phi_{left}, \phi_{right}]$ or if the loudspeaker arrangement is sparse (e.g., if the loudspeaker spacing d exceeds 15 cm-20 cm), the decision unit determines that SFS is not feasible.

Figure 6:
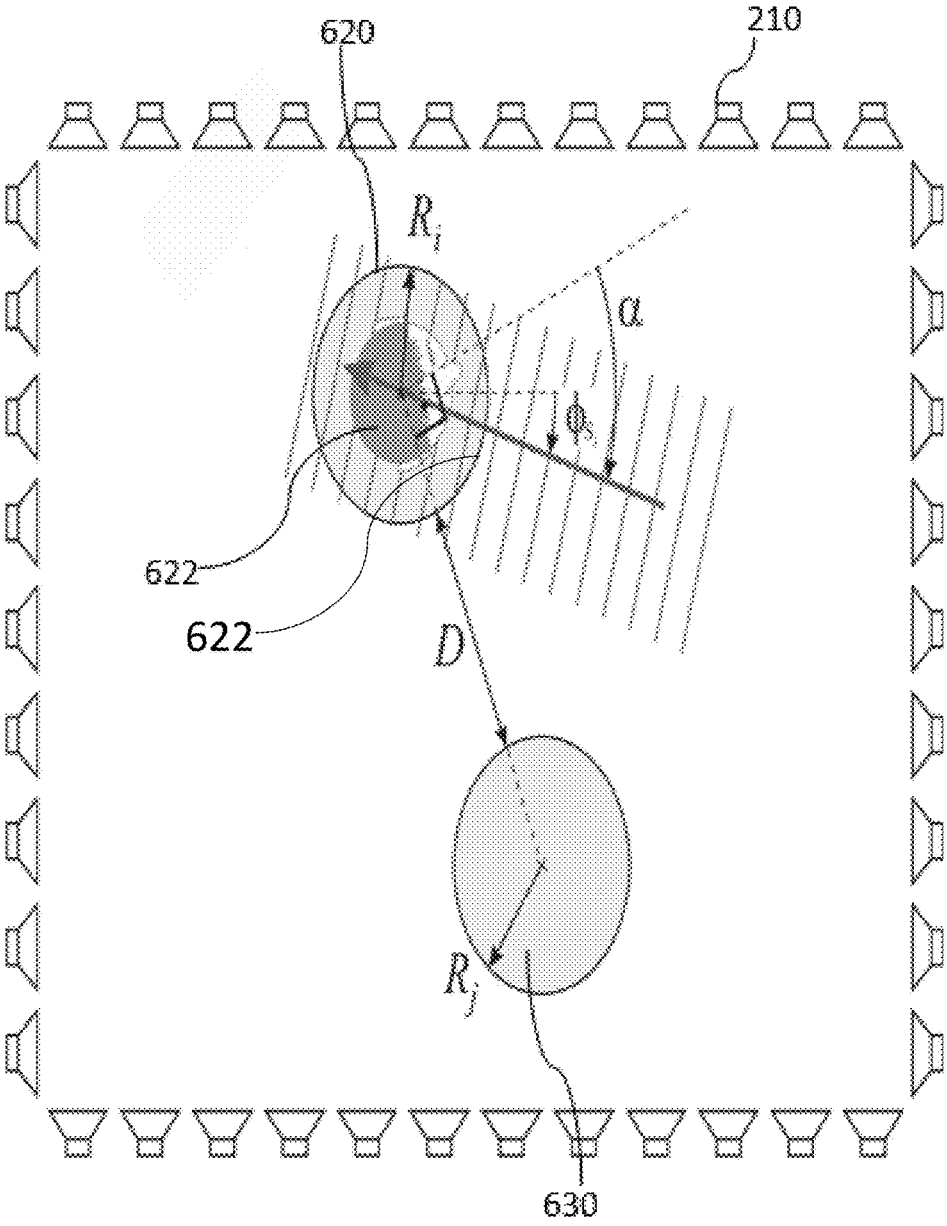
FIG. 6 illustrates a decision rule for determining a minimum angle $\phi_{min}$ in accordance with the present invention.
Figure 7A:
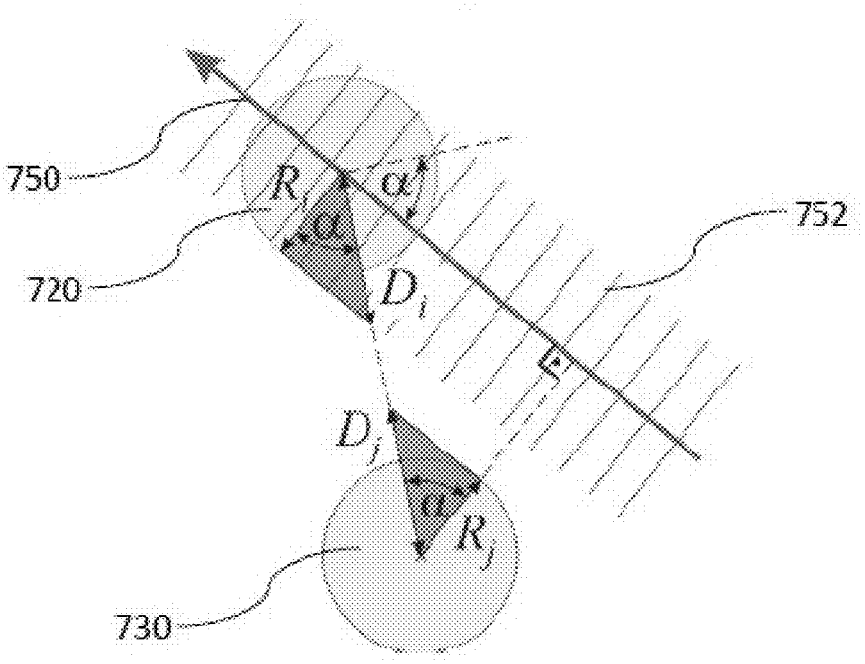
FIG. 7A illustrates a scenario where sound field synthesis is feasible.
Figure 7B:
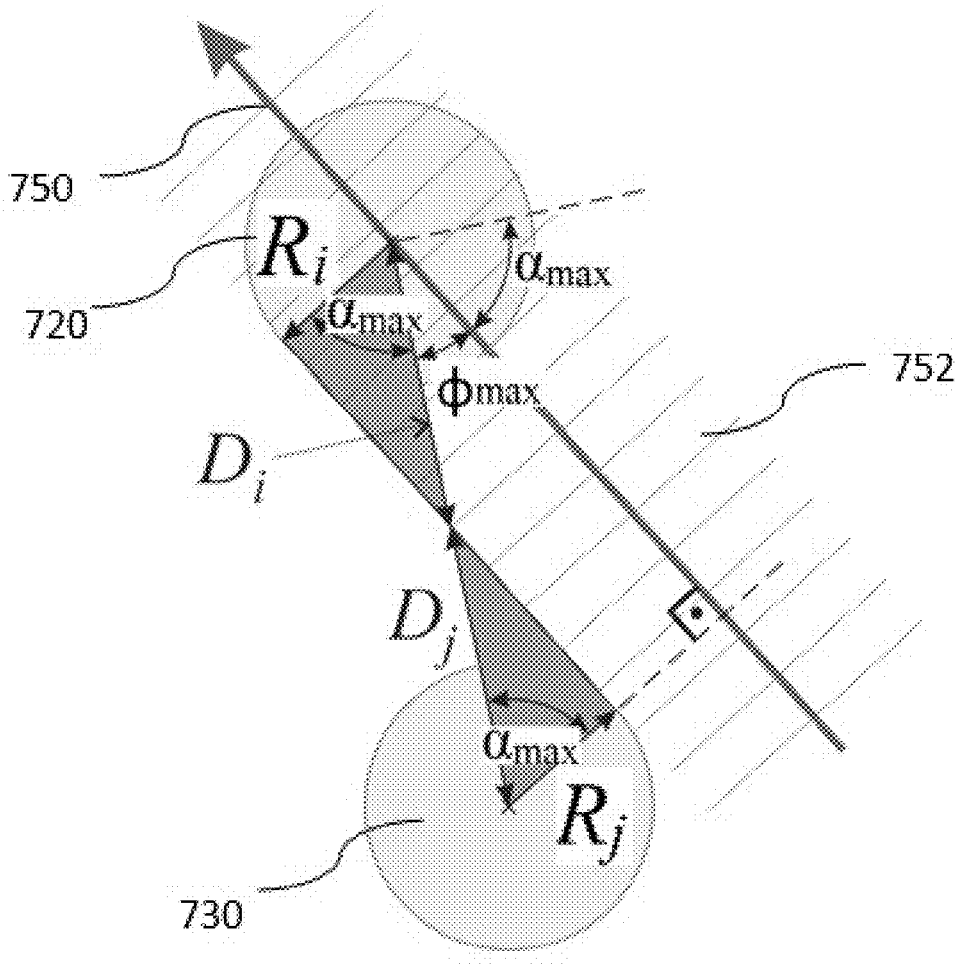
FIG. 7B illustrates a borderline scenario where sound field synthesis is still feasible.

FIGS. 6, 7A and 7B illustrate decision rules for determining for determining $\phi_{min}$ in accordance with the present invention. As illustrated in FIG. 6, the distance D is defined as the distance between the edges of a bright zone 620 (where listener 622 is located at the center) and a dark zone 630, where the corresponding zone radii are $R_i$ and $R_j$, respectively. Angle α denotes the angular separation between source direction $\phi_{S_i}$ and a line perpendicular to the line connecting the centers of dark zone 630 and bright zone 620. Note that, for a proposed simple decision rule, sound waves are modelled as traveling in a straight channel, i.e., their spatial extension is limited sharply.

FIG. 7A shows a reasonable scenario where SFS is feasible: Bright zone 720 and dark zone 730 are sufficiently far apart and the sound waves 752 along the direction 750 do not travel through the dark zone 730.

FIG. 7B shows a borderline case, where the direction 750 of the sound waves 752 is closer to the dark zone 730, but SFS is still feasible. The maximum angle $\phi_{min}=90°-|\alpha_{max}|$ is defined together with the maximum angle $\alpha_{max}$. This borderline case is given if $D_i+D_j=D+R_i+R_j$ holds, with D being defined as the distance between the bright zone 720 and the dark zone 730. Furthermore, $D_i$ and $D_j$ are defined as $$D_i = \frac{R_i}{\cos\alpha} \text{ and } D_j = \frac{R_j}{\cos\alpha}.$$

For angle α, this borderline case corresponds to $$|\alpha_{max}| = \arccos\left(\frac{R_i + R_j}{D + R_i + R_j}\right).$$

A more flexible decision rule, where an addition parameter γ≥1 is introduced, results in a larger angle $|\alpha_{max}|$ and, thus, in a smaller angle $\phi_{min}$. The corresponding more flexible rule is given by $$|\phi_{min}| = 90° - \arccos\left(\min\left\{\gamma\frac{R_i + R_j}{D + R_i + R_j}, 1\right\}\right),$$

where the argument of arccos is upper bound to one.

As described above, the proposed system can go beyond a straightforward approach, where a possible combination of BR and SFS merely depends on the frequency. Here, also the number and/or positions of the loudspeakers, the positions and/or extents of the virtual sources, and the local listening areas are taken into account, which are crucial parameters determining whether a certain reproduction approach is feasible or not.

Figure 8:
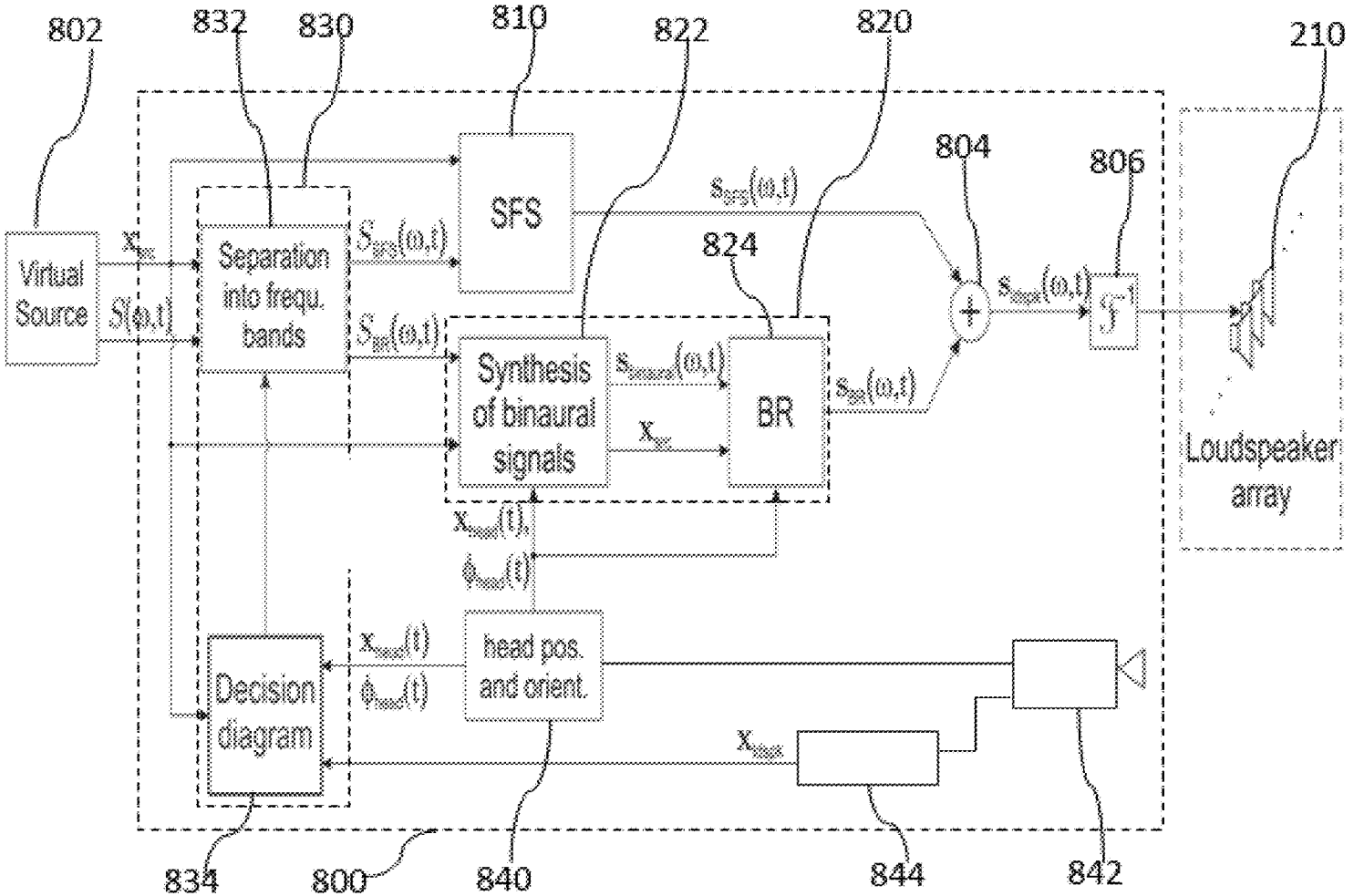
FIG. 8 shows a detailed block diagram of a wave field synthesis apparatus according to the invention that is provided with a virtual source unit as input.

FIG. 8 is a block diagram of a wave field synthesis apparatus 800 that is provided with a virtual source unit 802 as input. The wave field synthesis apparatus 800 generates drive signals for driving an array of loudspeakers 210. A virtual source to be synthesized is defined by its Short-Time Fourier Transform (STFT) spectrum S(ω, t) and its position vector $x_{src}$ in the 3D space, with ω and t denoting angular frequency and time frame, respectively. As shown in FIG. 8, the spectrum S(ω, t) and the position vector $x_{src}$ (which may also be time-dependent), can be provided by the virtual source unit 802 that is external to the wave field synthesis apparatus. In other embodiments, the wave field synthesis apparatus 800 can comprise a virtual source unit that is adapted to compute the spectrum S(ω, t) and the position vector $x_{src}$ within the wave field synthesis apparatus 800.

The spectrum S(ω, t) and the position vector $x_{src}$ are provided to a decision unit 830. The decision unit 830 comprises a filter bank 832 and a decision diagram unit 834, which is configured to define the bands (e.g., the cut-off frequencies) that are used by the filter bank 832.

Based on the above-described decision rules, the filter bank 832 separates the source spectrum S(ω, t) into a first-band spectrum $S_{SFS}(\omega, t)$ and a second-band spectrum $S_{BR}(\omega, t)$, which are to be reproduced by sound field synthesis and binaural reproduction, respectively.

The second-band spectrum $S_{BR}(\omega, t)$ and the position vector $x_{src}$ of the virtual source are provided as inputs to a binaural renderer 820. Furthermore, a time-dependent head position $x_{head}(t)$ and a time-dependent head orientation $\phi_{head}(t)$ are provided to the binaural renderer 820. The binaural renderer 820 comprises a synthesis unit 822 for generating binaural signals $s_{binaural}(\omega, t)$ based on the position $x_{src}$ of the virtual source as well as the current head position $x_{head}(t)$ and a current orientation $\phi_{head}(t)$ of the listener. To this end, the synthesis unit 822 uses Head-Related Transfer Functions (HRTFs) which are either modelled in the synthesis unit 822 or obtained from an HRTF measurement database (not shown in FIG. 8). The binaural signals $s_{binaural}(\omega, t)$ are adapted if the listener moves or rotates its head. The binaural signals serve as an input for the binaural reproduction unit 824 of the binaural renderer 820, where, e.g., a cross-talk canceller or binaural beamforming system can be deployed. Those binaural signals $s_{binaural}(\omega, t)$ and/or the source signal are then processed by the corresponding filters describing the BF or SFS system in a frame-wise manner using an STFT. The signals generated by the binaural reproduction stage and the sound field synthesis stage are denoted as $s_{BR}(\omega, t)$ and $S_{SRS}(\omega, t)$, respectively. Finally, $s_{BR}(\omega, t)$ and $S_{SFS}(\omega, t)$ are added at the adding unit 804 in order to obtain the driving signals $s_{ldspk}(\omega, t)$ in frequency domain, which are transformed into the time domain via an inverse STFT at the STFT unit 806 and finally reproduced via the loudspeakers 210 after D/A conversion.

The wave field synthesis apparatus 800 comprises a head position and orientation detection unit 840 that is configured to detect a head position and orientation of a listener in image frames that are acquired by a camera 842. Furthermore, the wave field synthesis apparatus comprises an object detection unit 844 that also obtains image frames from the camera 842. The object detection unit 844 can e.g. detect the positions $x_{ldspk}$ of the loudspeakers 210 and provide this information to one or more units of the wave field synthesis apparatus 800, in particular the decision diagram unit 834.

Figure 9:
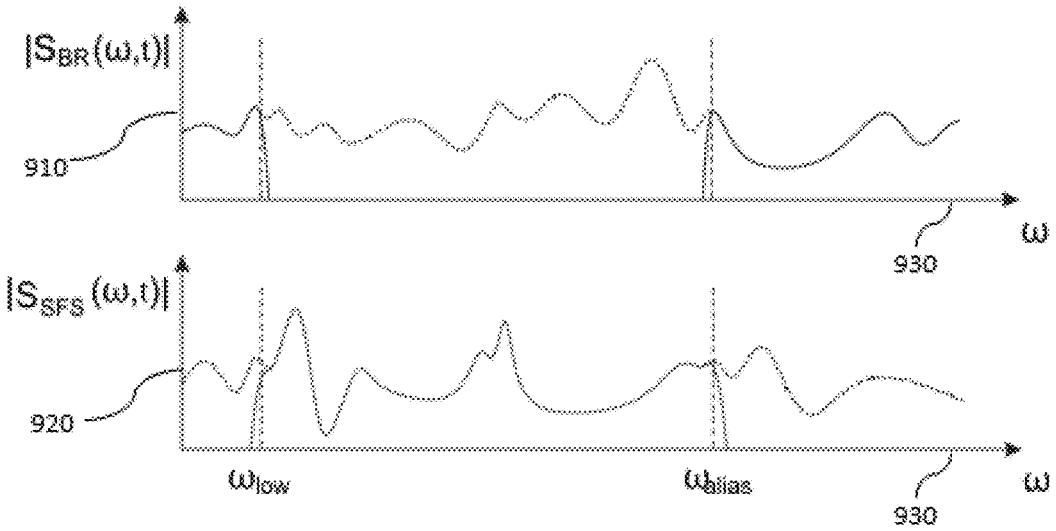
FIG. 9 illustrates a magnitude of the spectrum of the binaural drive signal and a magnitude of the spectrum of the sound field drive signals.

FIG. 9 illustrates the magnitude 910 of the spectrum of the binaural drive signal and the magnitude 920 of the spectrum of the sound field drive signals. The horizontal axes 930 represent the angular frequency ω. As schematically illustrated in FIG. 9 for a single channel, the transition between SFS and BF is smooth and not abrupt.

To summarize, an apparatus and a method for driving an array of loudspeakers with drive signals are presented. Embodiments of the invention combine the advantages of sound field synthesis and binaural rendering. For example, rendering can be maintained even in cases where local sound field synthesis is not feasible and/or not reasonable by utilizing less robust binaural rendering. The robustness of binaural rendering can be increased by utilizing more robust sound field synthesis in mid-frequency ranges.

Embodiments of the present invention allow more flexibility for placing the loudspeakers, require fewer loudspeakers to achieve the same rendering quality, are less complex, more robust, require less hardware and improve the frequency range.

In this invention, binaural rendering and sound field synthesis can be combined such that the benefits of both approaches can be exploited. That is, for scenarios and frequency ranges, where sound field synthesis is not reasonable, binaural rendering can be utilized as a fallback solution. If sound field synthesis is feasible in certain frequencies, it supports binaural rendering and thereby increases the robustness of the system with respect to head movements.

The invention has been described in conjunction with various embodiments herein. However, other variations to the disclosed embodiments can be understood and effected by those skilled in the art in practicing the claimed invention, from a study of the drawings, the disclosure and the appended claims. In the claims, the word "comprising" does not exclude other elements or steps and the indefinite article "a" or "an" does not exclude a plurality. A single processor or other unit may fulfil the functions of several items recited in the claims. The mere fact that certain measures are recited in usually different dependent claims does not indicate that a combination of these measures cannot be used to advantage.

Embodiments of the invention may be implemented in a computer program for running on a computer system, at least including code portions for performing steps of a method according to the invention when run on a programmable apparatus, such as a computer system or enabling a programmable apparatus to perform functions of a device or system according to the invention.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; non-volatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality. For example, the wave field synthesis apparatus 800 may include a virtual source unit 802.

Furthermore, those skilled in the art will recognize that boundaries between the above de-scribed operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

What is claimed is:

1. A wave field synthesis apparatus for driving an array of loudspeakers with drive signals, the apparatus comprising:

a sound field synthesizer configured to generate sound field drive signals for causing the array of loudspeakers to generate one or more sound fields at one or more audio zones, a binaural renderer configured to generate binaural drive signals for causing the array of loudspeakers to generate specified sound pressures in at least two positions, wherein the at least two positions are determined based on at least one of a detected position or orientation of a listener, and a decision device configured to decide whether to generate the drive signals using the sound field synthesizer or using the binaural renderer based on a virtual position of a virtual sound source at one or more locations of the one or more audio zones;

wherein when the one or more audio zones comprises more than one audio zone, the decision device is configured to decide to generate the drive signals for a selected audio zone of the more than one audio zone using the sound field synthesizer when an angular direction from the selected audio zone to a virtual source of one of the one or more sound fields deviates by more than a predefined angle from one or more angular directions from the selected audio zone to one or more remaining audio zones of the more than one audio zone.

2. The apparatus of claim 1, wherein the decision device is configured to decide further based on defined positions of the array of loudspeakers, at least one of a virtual orientation and a virtual extent of a virtual sound source, extent of the one or more audio zones, and at least one of the detected position of a listener or the detected orientation of a listener.

3. The apparatus of claim 1, wherein the decision device is configured to decide to generate the drive signals for a selected audio zone of the one or more audio zones using the sound field synthesizer when a sufficient number of loudspeakers of the array of loudspeakers are located in a virtual tube around a virtual line between a listener position and a virtual position of a virtual source.

4. The apparatus of claim 1, wherein the angular directions are determined based on centers of the selected audio zone and the one or more remaining audio zones.

5. The apparatus of claim 1, wherein the one or more audio zones comprise a dark zone that is substantially circular, and a bright zone that is substantially circular, wherein the decision device is configured to decide to generate the drive signals using the sound field synthesizer when a following condition is met:

$$|\phi| \geq 90^\circ - \arccos\left(\min\left\{\gamma\frac{R_i + R_j}{D + R_i + R_j}, 1\right\}\right)$$

wherein φ is an angle between an angular direction from a center of the bright zone to a center of the dark zone and an angular direction from the center of the bright zone to a location of a virtual source, Ri is a radius of the bright zone, Rj is a radius of the dark zone, D is a distance between a center of the first zone and a center of the second zone, and γ is a predetermined parameter with $|\gamma| \geq 1$.

6. The apparatus of claim 1, further comprising a splitter for separating a source signal into one or more split signals based on a property of the source signal, wherein the decision device is configured to decide for each of the split signals whether to generate corresponding drive signals using the sound field synthesizer or using the binaural renderer.

7. The apparatus of claim 6, wherein the decision device is configured to set one or more parameters of the splitter.

8. The apparatus of claim 6, wherein the splitter is a filter bank for separating the source signal into one or more bandwidth-limited signals.

9. The apparatus of claim 8, wherein the filter bank is configured to separate the source signal into two or more bandwidth-limited signals that partially overlap in frequency domain.

10. The apparatus of claim 1, wherein the binaural renderer is configured to generate the binaural drive signals based on one or more head-related transfer functions, wherein the one or more head-related transfer functions are retrieved from a database of head-related transfer functions.

11. A method for driving an array of loudspeakers with drive signals to generate one or more local wave fields at one or more audio zones, the method comprising:

detecting at least one of a position or an orientation of a listener;

deciding whether to generate the drive signals using a sound field synthesizer or whether to generate the drive signals using a binaural renderer based on a virtual position of a virtual sound source at one or more locations of the one or more audio zones, wherein when the one or more audio zones comprises more than one audio zone, a decision device is configured to decide to generate the drive signals for a selected audio zone of the more than one audio zone using the sound field synthesizer when an angular direction from the selected audio zone to a virtual source of one of the one or more sound fields deviates by more than a predefined angle from one or more angular directions from the selected audio zone to one or more remaining audio zones of the more than one audio zone, and implementing one of the following:

generating sound field drive signals for causing the array of loudspeakers to generate one or more sound fields at one or more audio zones, and generating binaural drive signals for causing the array of loudspeakers to generate specified sound pressures in at least two positions, wherein the at least two positions are determined based on at least one of the detected position or the detected orientation of the listener.

12. The method of claim 11, wherein the loudspeakers are located in a car.

13. The method of claim 12, wherein detecting at least one of the position or the orientation of the listener comprises: detecting which seat of the car is occupied by the listener.

14. A non-transitory computer-readable storage medium storing program code, the program code comprising processor-readable instructions which when executed by a processor cause the processor to implement operations for driving an array of loudspeakers with drive signals to generate one or more local wave fields at one or more audio zones, the operations including:

detecting at least one of a position or an orientation of a listener;

deciding whether to generate the drive signals using a sound field synthesizer or whether to generate the drive signals using a binaural renderer based on a virtual position of a virtual sound source at one or more locations of the one or more audio zones, wherein when the one or more audio zones comprises more than one audio zone, a decision device is configured to decide to generate the drive signals for a selected audio zone of the more than one audio zone using the sound field synthesizer when an angular direction from the selected audio zone to a virtual source of one of the one or more sound fields deviates by more than a predefined angle from one or more angular directions from the selected audio zone to one or more remaining audio zones of the more than one audio zone; and implementing one of the following:

generating sound field drive signals for causing the array of loudspeakers to generate one or more sound fields at one or more audio zones, and generating binaural drive signals for causing the array of loudspeakers to generate specified sound pressures in at least two positions, wherein the at least two positions are determined based on at least one of the detected position or the detected orientation of the listener.

15. The non-transitory computer-readable storage medium of claim 14, wherein the loudspeakers are located in a car, wherein the operation of detecting at least one of the position or the orientation of the listener comprises: detecting which seat of the car is occupied by the listener.

* * * * *